US006992053B2

(12) United States Patent
Cermenati et al.

(10) Patent No.: US 6,992,053 B2
(45) Date of Patent: Jan. 31, 2006

(54) HARD SURFACE CLEANING COMPOSITION COMPRISING A BLEACH, ACID, AND SILICONE GLYCOL POLYMER

(75) Inventors: Laura Cermenati, Turin (IT); Vincenzo Tomarchio, Alcamo TP (IT)

(73) Assignee: The Procter & Gamble Company, Cincinnati, OH (US)

( * ) Notice: Subject to any disclaimer, the term of this patent is extended or adjusted under 35 U.S.C. 154(b) by 0 days.

(21) Appl. No.: 10/105,785

(22) Filed: Mar. 25, 2002

(65) Prior Publication Data

US 2002/0193270 A1 Dec. 19, 2002

(51) Int. Cl.

| | |
|---|---|
| ***C11D 3/395*** | (2006.01) |
| ***C11D 7/08*** | (2006.01) |
| ***C11D 9/36*** | (2006.01) |

(52) U.S. Cl. ..... 510/238; 510/218; 510/234; 510/235; 510/245; 510/247; 510/191; 510/253; 510/269; 510/362; 510/367; 510/372; 510/375; 510/466

(58) Field of Classification Search ..... 510/218, 510/234, 235, 238, 245, 247, 191, 253, 269, 510/362, 367, 372, 375, 466, 276

See application file for complete search history.

(56) References Cited

U.S. PATENT DOCUMENTS

| | | | | | |
|---|---|---|---|---|---|
| 4,400,288 | A | * | 8/1983 | Dhanani et al. | 510/347 |
| 4,732,694 | A | * | 3/1988 | Gowland et al. | 516/117 |
| 5,185,096 | A | * | 2/1993 | Ahmed | 510/221 |
| 5,336,427 | A | | 8/1994 | Bunczk et al. | |
| 5,759,523 | A | | 6/1998 | Hughes et al. | |
| 6,113,655 | A | * | 9/2000 | Tsunetsugu et al. | 8/137 |
| 6,204,234 | B1 | * | 3/2001 | Herbots et al. | 510/321 |
| 6,489,278 | B1 | * | 12/2002 | Lentsch et al. | 510/218 |

FOREIGN PATENT DOCUMENTS

| | | |
|---|---|---|
| EP | 0 046 342 A1 | 2/1982 |
| EP | 0 163 352 A2 | 12/1985 |
| EP | 0 483 411 A1 | 5/1992 |
| EP | 0 598 694 B1 | 2/1998 |
| EP | 0 832 964 A1 | 4/1998 |
| EP | 0 729 901 B1 | 7/2000 |
| GB | 2 200 365 A | 8/1988 |
| WO | WO 96/00274 | 1/1996 |
| WO | WO 97/36980 | 10/1997 |
| WO | WO 99/27031 | 6/1999 |
| WO | WO 99/38481 | 8/1999 |

* cited by examiner

*Primary Examiner*—Charles Boyer
(74) *Attorney, Agent, or Firm*—Thibault Fayette; Kim W. Zerby; Steven W. Miller

(57) ABSTRACT

The present invention encompasses a composition, suitable for cleaning hard surfaces, comprising a bleaching agent and a silicone glycol.

16 Claims, No Drawings

HARD SURFACE CLEANING COMPOSITION COMPRISING A BLEACH, ACID, AND SILICONE GLYCOL POLYMER

CROSS REFERENCE TO RELATED APPLICATIONS

This application claims priority under 35 U.S.C. §119(a) to European Application Serial No. 01870062.5, filed Mar. 26, 2001.

TECHNICAL FIELD

The present invention relates to compositions, more particularly to liquid or solid compositions, for cleaning a surface, comprising a bleach and a silicone glycol. Said compositions are particularly suitable for the bleaching and cleaning of hard surfaces including toilet bowls and the like.

BACKGROUND

A great variety of cleaning compositions have been described in the art. Indeed, compositions for cleaning hard surfaces, especially for hard surfaces found in bathrooms, such as sanitary fittings (e.g., toilet bowls), bathroom tiles, etc., are already known in the art.

Examples of compositions known in the art include liquid acidic cleaning compositions suitable for cleaning hard surfaces comprising a persulfate bleaching agent (EP-A-0 598 694), or liquid, thickened toilet bowl cleaning compositions comprising a sulphonate surfactant and a quaternary ammonium surfactant (EP-A-0 832 964), or acidic toilet bowl cleaning compositions comprising sulphuric acid and a specific chelating agent (EP-A-0 729 901).

Even though, the currently known compositions according to the above cited art provide a good performance with regard to cleaning performance, it has been found by consumer research that the cleaning performance of the compositions can be further improved. Indeed, consumers are looking for cleaning compositions that not only clean hard surfaces treated therewith but also that said surfaces remain clean over a significant period of time after first being cleaned with such a cleaning composition.

Indeed, surfaces found in bathrooms in general and toilet bowl surfaces in particular are subject to significant resoiling with soils, such as feces, biofilm (bacteria, fungi, algae, and the like), soap scum, etc., and/or limescale build-up and/or mineral encrustation build-up after an initial cleaning action.

It is therefore an objective of the present invention to provide a composition for cleaning a surfaces, wherein said composition provides excellent overall cleaning performance on the surfaces treated therewith and renders said surfaces less prone to resoiling, limescale build-up and/or mineral-encrustation build-up.

It has now been found that the above objective can be met by a composition according to the present invention.

Advantageously, the compositions as described herein may be used to clean surfaces made of a variety of materials like glazed and non-glazed ceramic tiles, enamel, stainless steel, Inox®, Formica®, vinyl, no-wax vinyl, linoleum, melamine, glass, plastics and plastified wood.

A further advantage of the present invention is that the compositions according to the present invention have the ability to provide long lasting shine to the surface they have cleaned.

A further advantage is that this composition can provide an antibacterial action while cleaning.

BACKGROUND ART

The following documents are representative of the prior art available on hard surface cleaning compositions.

WO 97/36980 describes acidic compositions comprising a polyalkylene oxide-modified polydimethylsiloxanes.

WO 99/27031 describes the use of polysiloxanes comprising polyether units as demisting agents.

WO 96/00274 describes silicone glycols in cleaning compositions wherein streaking of said compositions is prevented.

SUMMARY OF THE INVENTION

The present invention encompasses compositions comprising a bleaching agent and a silicone glycol.

In a preferred embodiment herein, said bleaching agent is a source of active oxygen or a mixture thereof.

In another preferred embodiment herein, the silicone glycol raw-material in the compositions herein is substantially free of: heavy metal ions and/or their complexes; and/or un-reacted polyether chains comprising a C═C double bond functionality; and/or un-reacted polysiloxanes.

DETAILED DESCRIPTION OF THE INVENTION

Surfaces to be Cleaned

The compositions according to the present invention are suitable to clean a surface. Any type of surface prone to soiling may be cleaned with the compositions herein. Preferably, the surfaces herein are hard-surfaces, more preferably hard-surfaces typically found in houses like kitchens, bathrooms, or in car interiors or exteriors, e.g., floors, walls, tiles, windows, cupboards, sinks, showers, shower plastified curtains, wash basins, toilet bowls, urinals, fixtures and fittings and the like made of different materials like ceramic, enamel, vinyl, no-wax vinyl, linoleum, melamine, glass, Inox®, Formica®, any plastics, plastified wood, metal or any painted or varnished or sealed surface and the like. Hard-surfaces also include household appliances including, but not limited to refrigerators, freezers, washing machines, automatic dryers, ovens, microwave ovens, dishwashers, computers and the like. In addition, the surface herein may be the surface of a denture, this means the composition herein may also be used as a denture cleaner.

In a highly preferred embodiment the surfaces herein are hard-surfaces found in bathrooms, such as tiles, sinks, showers, wash basins, toilet bowls, urinals, bath tubs, fixtures and fittings and the like made of different materials like ceramic, enamel, glass, Inox®, Formica®, or metal and the like. Even more preferably, the surface herein are toilet bowls and urinals, most preferably the inside portion of a toilet bowls and urinals.

Composition

The composition of the present invention is either formulated as a liquid or solid composition.

In the preferred embodiment, wherein the compositions herein are solid compositions, the composition may for example come in the form of a powder, as granules, as pressed granules and/or powders (such as tablets), extruded solid compositions, and the like. Preferably, the solid compositions herein are in the form of a tablet, such as a rim blocks for toilet or urinals, preferably to be placed directly into toilet bowl or urinal or into the fresh water tank of a WC or a urinal, or mechanical cleaning devices.

In the preferred embodiment, wherein the compositions herein are liquid, the compositions are preferably thickened compositions. The thickened compositions herein may be in the form of a gel or a pasteous composition.

Preferred thickened compositions of the present invention have a viscosity of 2 cps or greater, more preferably of from 2 to 5000 cps, and still more preferably of from 10 to 2500 cps at 20° C. when measured with a Carri-Med Rheometer model $CSL^2$ 100® (Supplied by TA Instruments) with a 4 cm conic spindle in stainless steal (linear increment from 1 to 70 $sec^{-1}$ in max. 8 minutes).

Most preferred thickened compositions have a shear thinning profile. Most preferably the viscosity should be in the range of 100–500 cps at 10 $sec^{-1}$, 50–400 cps at 30 $sec^{-1}$ and 10–50 cps at 700 $sec^{-1}$.

It is at these preferred viscosities where the thickened compositions herein show a good distribution of the composition over the surface to be cleaned as well as an adherence to said surface sufficient to stick to the surface during the cleaning operation itself. Furthermore, the rinsing-off of said composition of the surface after the cleaning is also beneficial.

A preferred liquid composition herein is an aqueous composition and therefore, preferably comprises water more preferably in an amount of from 20% to 99%, even more preferably of from 75% to 97% and most preferably 80% to 97% by weight of the total composition.

The pH of the liquid composition according to the present invention may typically be from 0 to 14.

In the preferred embodiment herein, wherein the composition comprises a source of active oxygen as the bleaching agent, the pH of the liquid compositions herein, as is measured at 25° C., is at least, with increasing preference in the order given, 0.1, 0.15, 0.2, 0.25, 0.3, or 0.4. Independently, the pH of the thickened compositions herein, as is measured at 25° C., preferably is no more than, with increasing preference in the order given, 14, 13, 12, 11, 10, 9, 8, 7, 6, 6, 5, 4.5, 4, 3.5, 3, 2.5, 2, 1.75, 1.5, 1.25, 1, 0.75, 0.5, 0.45 or 0.4.

In the preferred embodiment herein, wherein the composition comprises a hypohalite bleach as the bleaching agent, the pH of the liquid compositions herein, as is measured at 25° C., is at least, with increasing preference in the order given, 7, 7.5, 8, 8.5, 9, 9.5, 10, 10.5, 11 or 11.5. Independently, the pH of the thickened compositions herein, as is measured at 25° C., preferably is no more than, with increasing preference in the order given, 14, 13.75, 13.5, 13.25, 13, 12.5, or 12.

In the preferred embodiment herein, wherein the composition comprises a source of active oxygen as the bleaching agent, the pH of the solid composition according to the present invention at a dilution with water of 1%, may typically be from 0 to 14. Preferably, the pH of the solid compositions herein, comprising a source of active oxygen as the bleaching agent, at a dilution with water of 1%, as is measured at 25° C., is at least, with increasing preference in the order given, 0, 1, 2, 3, 4, 5, 6, 7. Independently, the pH of the solid compositions herein, as is measured at 25° C., preferably is no more than, with increasing preference in the order given, 14, 13, 12, 11, 10, 9 or 8.

In the preferred embodiment herein, wherein the composition comprises a hypohalite bleach as the bleaching agent, the pH of the solid composition according to the present invention at a dilution with water of 1%, may typically be from 0 to 14. Preferably, the pH of the solid compositions herein, comprising a hypohalite bleach as the bleaching agent, at a dilution with water of 1%, as is measured at 25° C., is at least, with increasing preference in the order given, 7, 7.5, 8, 8.5, 9, 9.5, 10, 10.5, 11 or 11.5. Independently, the pH of the thickened compositions herein, as is measured at 25° C., preferably is no more than, with increasing preference in the order given, 14, 13.75, 13.5, 13.25, 13, 12.5, or 12.

Accordingly, the compositions herein may further comprise an acid or base to adjust pH as appropriate. Preferably, the compositions herein may further comprise an acid, more preferably when a source of active oxygen is present. Preferably, the compositions herein may further comprise a base, more preferably when a hypohalite bleach is present.

Acidity further contributes to formulate compositions according to the present invention that exhibit good limescale removing performance whilst exhibiting also good disinfecting properties. Furthermore, it is at a low pH where the particularly preferred sources of active oxygen have a better stability profile. Accordingly, the compositions of the present invention may comprise organic and/or inorganic acids. Particularly suitable organic acids to be used herein are aryl and/or alkyl sulfonate, such as methane sulfonic acids, citric acid, succinic acid, sulphamic acid, maleic acid and the like. Particularly suitable inorganic acids are sulfuric, phosphoric, nitric acids and the like.

A typical level of such an acid, when present, is of from 0.01% to 15%, preferably from 1% to 10% and more preferably from 2% to 7% by weight of the total composition.

In another preferred embodiment, wherein said bleaching agent is a hypohalite bleach, suitable bases for use herein are the caustic alkalis, such as sodium hydroxide, potassium hydroxide and/or lithium hydroxide, and/or the alkali metal oxides such, as sodium and/or potassium oxide or mixtures thereof. A preferred base is a caustic alkali, more preferably sodium hydroxide and/or potassium hydroxide.

Other suitable bases include ammonia, ammonium carbonate and hydrogen carbonate.

Typical levels of such bases, when present, are of from 0.1% to 5% by weight, preferably from 0.3% to 2% and more preferably from 0.5% to 1.5% by weight of the composition.

Bleaching Agent

The compositions according to the present invention comprise, as an essential ingredient, a bleaching agent. Preferably, said bleaching agent is selected from the group consisting of sources of active oxygen, hypohalite bleaches and mixtures thereof.

The bleaching agent, preferably the source of active oxygen according to the present invention acts as an oxidising agent, it increases the ability of the compositions to remove colored stains and organic stains in general, to destroy malodorous molecules and to kill germs.

In a preferred embodiment according to the present invention said bleaching agent is a source of active oxygen or a mixture thereof.

Suitable sources of active oxygen for use herein are water-soluble sources of hydrogen peroxide including persulfate, dipersulphate, persulfuric acid, percarbonates, metal peroxides, perborates, persilicate salts, and mixtures thereof, as well as hydrogen peroxide, and mixtures thereof. As used herein a hydrogen peroxide source refers to any compound that produces hydrogen peroxide when said compound is in contact with water.

In addition, other classes of peroxides can be used as an alternative to hydrogen peroxide and sources thereof or in combination with hydrogen peroxide and sources thereof. Suitable classes include dialkylperoxides, diacylperoxides, preformed percarboxylic acids, organic and inorganic peroxides and/or hydroperoxides.

Suitable organic or inorganic peracids for use herein are selected from the group consisting of: persulphates such as monopersulfate; peroxyacids such as diperoxydodecandioic acid (DPDA) and phthaloyl amino peroxycaproic acid (PAP); magnesium perphthalic acid; perlauric acid; perbenzoic and alkylperbenzoic acids; and mixtures thereof.

Suitable hydroperoxides for use herein are selected from the group consisting of tert-butyl hydroperoxide, cumyl hydroperoxide, 2,4,4-trimethylpentyl-2-hydroperoxide, di-isopropylbenzene-monohydroperoxide, tert-amyl hydroperoxide and 2,5-dimethyl-hexane-2,5-dihydroperoxide and mixtures thereof. Such hydroperoxides have the advantage to be particularly safe to carpets and carpet dyes while delivering excellent bleaching performance.

Persulfate salts, or mixtures thereof, are the preferred sources of active oxygen to be used in the compositions according to the present invention. Preferred persulfate salt to be used herein is the monopersulfate triple salt. One example of monopersulfate salt commercially available is potassium monopersulfate commercialized by Peroxide Chemie GMBH under the trade name Curox®. Other persulfate salts such as dipersulphate salts commercially available from Peroxide Chemie GMBH can be used in the compositions according to the present invention.

Suitable hypohalite bleaches may be provided by a variety of sources, including bleaches that lead to the formation of positive halide ions and/or hypohalite ions, as well as bleaches that are organic based sources of halides, such as chloroisocyanurates.

Suitable hypohalite bleaches for use herein include the alkali metal and alkaline earth metal hypochlorites, hypobromites, hypoiodites, chlorinated trisodium phosphate dodecahydrates, potassium and sodium dichloroisocyanurates, potassium and sodium trichlorocyanurates, N-chloroimides, N-chloroamides, N-chloroamines and chlorohydantoins.

In a preferred embodiment wherein the compositions herein are liquid, said hypohalite bleach is an alkali metal and/or alkaline earth metal hypochlorite. More preferably, for liquid compositions said hypohalite bleach is an alkali metal and/or alkaline earth metal hypochlorite selected from the group consisting of sodium hypochlorite, potassium hypochlorite, magnesium hypochlorite, lithium hypochlorite and calcium hypochlorite, and mixtures thereof. Even more preferably, for liquid compositions said hypohalite bleach is sodium hypochlorite.

In another preferred embodiment wherein the compositions herein are solid, said hypohalite bleach is: an alkali metal or alkaline earth metal hypochlorite; chlorinated trisodium phosphate dodecahydrate; potassium dichloroisocyanurate; sodium dichloroisocyanurate; potassium trichlorocyanurate; sodium trichlorocyanurate; or a mixture thereof. More preferably, for solid compositions said hypohalite bleach is: an alkali metal or alkaline earth metal hypochlorite selected from the group consisting of lithium hypochlorite and calcium hypochlorite; chlorinated trisodium phosphate dodecahydrate; potassium dichloroisocyanurate; sodium dichloroisocyanurate; potassium trichlorocyanurate; sodium trichlorocyanurate; or a mixture thereof. Even more preferably, for solid compositions said hypohalite bleach is sodium dichloroisocyanurate and/or calcium hypochlorite.

The compositions according to the present invention may comprise from 0.1% to 30%, preferably from 0.1% to 20%, more preferably from 1% to 10%, and most preferably from 1% to 8% by weight of the total composition of said bleaching agent.

Silicone Glycol

The composition herein comprises a silicone glycol as an essential ingredient.

The composition herein preferably comprises up to 50%, more preferably of from 0.01% to 20%, even more preferably of from 0.01% to 10%, and most preferably of from 0.01% to 5%, by weight of the total composition of said silicone glycol.

Depending on the relative position of the silicone-polyether chains, the silicone glycol can be either linear or grafted.

Preferably, said silicone glycol is according to the following formulae:

Grafted structure

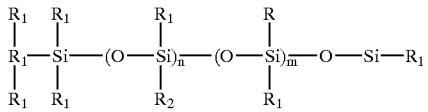

Linear structure

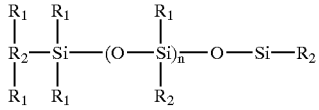

wherein: each $R_1$ independently is H or a hydrocarbon radical; $R_2$ is a group bearing a polyether functional group; n is an integer of from 0 to 500; and for the grafted structure m is an integer of from 1 to 300, and preferably with n+m more than 1.

In a highly preferred embodiment herein the polymer herein is a grafted silicone glycol.

Preferably, each $R_1$ independently is H or a hydrocarbon chain comprising from 1 to 16, more preferably a hydrocarbon chain comprising from 1 to 12 carbon atoms, and even more preferably $R_1$ is a $CH_3$-group. $R_1$ can also contain $NH_2$ groups and/or quaternary ammoniums.

Preferably, n is an integer of from 0 to 100, more preferably an integer of from 1 to 100, even more preferably n is an integer of from 1 to 50, and most preferably n is an integer of from 5 to 30.

Preferably, m (for the grafted structure) is an integer of from 1 to 80, more preferably m is an integer of from 1 to 30, and even more preferably m is an integer of from 2 to 10. Preferably, n+m is more than 2.

Preferably, $R_2$ is an alkoxylated hydrocarbon chain. More preferably, $R_2$ is according to the general formulae:

$$—R_3—(A)_p—R_4$$

wherein: $R_3$ is a hydrocarbon chain; A is an alkoxy group or a mixture thereof; p is an integer of from 1 to 50; and $R_4$ is H or a hydrocarbon chain, or —COOH.

Preferably, $R_3$ is a hydrocarbon chain comprising from 1 to 12, more preferably 3 to 10, even more preferably from 3 to 6, and most preferably 3 carbon atoms.

Preferably, A is an ethoxy or propoxy or butoxy unit or a mixture thereof, more preferably A is an ethoxy group.

Preferably, p is an integer of from 1 to 50, more preferably p is an integer of from 1 to 30, and even more preferably p is an integer of from 5 to 20.

Preferably, $R_4$ is H or a hydrocarbon chain comprising from 1 to 12, more preferably 1 to 6, even more preferably from 3 to 6, and still even preferably 3 carbon atoms, most preferably $R_4$ is H.

Preferably, the silicone glycol polymers suitable herein have an average molecular weight of from 500 to 100,000, preferably from 600 to 50,000, more preferably from 1000 to 40,000, and most preferably from 2,000 to 20,000.

Suitable, silicone glycol polymers are commercially available from General electric, Dow Coming, and Witco under the following tradenames:

| GE Bayer Silicones: | Dow Corning: | Witco: |
|---|---|---|
| SF1488 ® | DC 8692 ® | L-77 ® |
| SF1288 ® | Q4-3667 ® | L-7001 ® |
| SF1388 ® | DC 5067 ® | L-7087 ® |
| SF1328 ® | DC 1248 ® | L-7200 ® |
| SF1528 ® | DC 3225C ® | L-7210 ® |
| SF1188 ® | DC 5225C ® | L-7220 ® |
| TP3799 ® | DC 190 ® | L-7230 ® |
| TP3800 ® | DC 5247 ® | L-7280 ® |
| TP3801 ® | FF 400 ® | L-7500 ® |
| TP3804 ® | DC 5329 ® | L-7510 ® |
| TP3805 ® | DC 5220 ® | L-7550 ® |
| TP3806 ® | DC 5097 ® | L7600 ® |
| TSF4440 ® | DC 5604 ® | L-7602 ® |
| TSF4441 ® | DC 5197 ® | L-7604 ® |
| TSF4445 ® | DC 5103 ® | L-7605 ® |
| TSF4446 ® | DC 5093 ® | L-7607 ® |
| TSF4452 ® | DC 5237 ® | L-7608 ® |
| TSF4460 ® | DC 5098 ® | L-7622 ® |
| TSF4450 ® | DC 193 ® | L-7644 ® |
| AI3669 ® | DC 5200 ® | L-7650 ® |
| AI3465 ® | Sylgard 309 | L-7657 ® |
| AI3466 ® | DC 5211 ® | L-8500 ® |
| AI3467 ® | DC 5212 ® | L-8600 ® |
| AI3468 ® | | L-8610 ® |
| | | L-8620 ® |

In a highly preferred embodiment according to the present invention, the polymer herein is a Silicones-Polyethers copolymer, commercially available under the trade name SF 1288® from GE Bayer Silicones.

It has now been found, that the silicone glycol as described herein deposits onto the surfaces cleaned with a composition according to the present invention. Thereby, soil adherence, limescale and/or mineral encrustation build-up, is prevented in-between two cleaning operations.

Stability of the Compositions Herein

It has been found that even though the compositions herein are initially stable, a stability problem (chemical stability) upon storage of the compositions may arise. Indeed, the bleaching agent used in the compositions herein may start to decompose upon storage of the liquid compositions herein. The decomposition of the bleaching agent leads to a reduction of the total level of the bleach in a liquid composition and thereby impacts the cleaning/bleaching performance of the compositions herein. Furthermore, said decomposition may also result in the production of gas, which in turn may lead to bulging or even bursting of the containers used to package the compositions herein.

The Applicant has surprisingly found that this reduced chemical stability upon storage of the composition herein is not due to an interaction of the bleaching agent and the silicone glycol. Indeed, said reduced chemical stability is due to unwanted reaction of the bleaching agent with minor ingredients other than silicone glycol present in the commercially available silicone glycol-raw material, see above for a list of commercially available silicone glycol-raw materials (commercially available silicone glycol polymers).

A detailed description on different synthetic ways used to produce silicones glycols ("siloxane glycols") can be found in the book "Silicones Surfactants—Surfactant science series volume 86" edited by Randal M. Hill. Marcel Dekker, Inc. New York 1999 pages 7 to 13.

The first step of the synthesis of suitable silicone glycols is to prepare a siloxane backbone containing reactive sites (such as SiOH, SiOR or SiH) at which to attach a polyether chain. This can be done by either the co-hydrolysis of the appropriate chlorosilanes or the equilibration of the appropriate proportion of end-cap and monomer units. The reaction is generally catalyzed.

Siloxane glycols are prepared by attaching one or more polar organic groups to per-methylated siloxane backbone. The main synthetic way used to obtain siloxane-polyoxyalkylene copolymers hydrolytically stable is the direct hydrolysis between SiH and a polyether chain comprising a C═C double bond functionality for example, an allyl polyether, like $H_2C{=}CHCH_2{-}R$ wherein R is a polyether chain, preferably a polyether chain as described herein above:

$$\equiv SiH + CH_2{=}CHCH_2R \rightarrow \equiv SiCH_2CH_2CH_2R$$

wherein, ≡SiH stands for a polysiloxane backbone having a reactive SiH moiety or moieties.

This reaction is usually catalyzed by using platinum based catalyst, most preferably chloro-platinic acid (Speier's catalyst), and it is carried out with an excess of a polyether chain comprising a C═C double bond functionality in order to neutralize all the reactive sites (SiH) on the siloxane.

The Applicant has found that in the silicone glycol-raw material, compounds are present relating back to the above described synthesis of the silicone glycol. Indeed, such material includes : heavy-metal based catalyst, in particular platinum based catalyst; un-reacted C═C double bonds from the excess of polyether as described above used during the synthetic process; and un-reacted polysiloxane.

Without being bound by theory, it is believed that one or more of the above described compounds present in the silicone glycol-raw material other than the silicone glycols itself are responsible for the reduced chemical stability upon storage of the bleaching agent. In particular, it has been found that this reduced chemical stability upon storage of the bleaching agent is even worsened at the preferred conditions according to the present invention. Indeed, at low pH, such as a pH below 3, and in the event that the bleaching agent herein is a peroxygen bleach, preferably hydrogen peroxide and potassium monopersulfate, the chemical stability upon storage is even further reduced.

Moreover, the Applicant has found that the prevention of the decomposition of bleaching agents by adding a chelating agent, which is a commonly used way of stabilizing bleaching agents in compositions, fails to provide a significant stabilisation. This is believed to be due to the fact that the heavy metal catalyst present in the silicone glycol-raw material is not present as a free ion but in one of its complexes forms (e.g. chelated state) and the addition of a further chelant, thus does not provide additional improvements in terms of chemical stability of the bleaching agent.

The Applicant has found that in order to provide compositions that are stable upon storage, the silicone glycol-raw material has to be purified. Therefore, in a highly preferred embodiment according to the present invention, the compositions herein comprise a silicone glycol, wherein the silicone glycol-raw material is substantially free, preferably free, of further ingredients other than the silicone glycol itself.

By 'substantially free of further ingredients other than the silicone glycol itself' it is meant herein, that the silicone glycol-raw material comprises more than 80%, preferably more than 85%, more preferably more than 90%, even more preferably more than 95%, and most preferably more than 99% of silicone glycol.

However, the silicone glycol-raw material may comprise water.

In another preferred embodiment according to the present invention, the silicone glycol-raw material comprises less than 20%, preferably less than 15%, more preferably less than 10%, of un-reacted polyether chain containing C=C double bonds. Moreover, it has been found that the presence of un-reacted polyether chain free of C=C double bonds do not or have a reduced negative impact on the stability of the compositions herein.

In another preferred embodiment according to the present invention the silicone glycol-raw material comprises less than 2.5 ppm, preferably less than 2 ppm, more preferably less than 1.5 ppm even more preferably less than 1 ppm and most preferably less than 0.7 ppm by weight of the total composition of heavy metal, preferably Platinum, in the form of heavy metal catalysts-containing catalysts, preferably Pt-containing catalysts, and/or free heavy metal ions, preferably free Platinum.

A suitable silicone glycol-raw material can be produced by diluting the silicone glycol-raw material after polymerization with a suitable solvent, such as water or another polar solvent, treating the silicone glycol-raw material active carbon and subsequently filtering out the carbon after few hours, preferably up to 12 hours, at elevated temperatures, such as 100° C. The water or other solvent can be stripped out or left after treatment.

The chemical stability upon storage of the compositions herein can be assessed by the following test method:

The gas evolution rate study (1) and hydrogen peroxide loss (2).

1) Gas evolution rate (GER): sealed glass bottles are filled with product by leaving a Volume $V_0$ of measured headspace. The bottles are provided with a pressure detector, measuring the pressure in the headspace in a continuous way for at least 5 days when the sealed bottle is stored at constant temperature (35° C.). After 2 days a linear increase of the pressure in the headspace is obtained and the GER (expressed in ml of gas developed in 1 day by 1 lt. of product) can be calculated based on the ideal gas equation.

2) Hydrogen peroxide levels in a given product at different points in time upon storage are calculated over aging by using potentiometric titration, preferably iodometric titration.

Processes

The present invention encompasses a process of cleaning a surface with a composition according to the present invention, wherein said process comprises the step of applying said composition onto said surface.

Preferably, said process of cleaning a surface additionally comprises the steps of leaving said composition to act on said surface and subsequently removing said composition from said surface by rinsing it off, such as flushing a toilet.

In said process of cleaning a surface the liquid composition may be used in its neat or diluted form. In said process of cleaning a surface the solid composition may be used in dissolved form.

By "in its diluted form" it is meant herein that said compositions may be diluted with water up to 99% of water. Said dilution may occur either before, after or while said composition is applied to said surface.

By "in dissolved form" it is meant herein that said solid compositions may be dissolved in water. Said dissolution may occur either before, after or while said composition is applied to said surface.

Furthermore, the present invention encompasses the manufacture of a composition for use in one of the processes as described herein above.

Optional Ingredients in the Compositions Herein

Perfumes

The compositions according to the present invention may comprise, as an optional ingredient, perfume ingredient selected from the group consisting of: a cyclic terpene/sesquiterpene perfume, such as eucalyptol, cedrol, pinocarveolus, sesquiterpenic globulul alcohol; linalo; tetrahydrolinalo; verdox (cyclohexadiyl 2 tetryl butyl acetate); 6,3 hexanol; and citronellol and mixtures thereof.

The compositions according to the present invention may comprise from 0.01% to 10%, preferably from 0.01% to 5%, more preferably from 0.01% to 1%, and most preferably from 0.01% to 0.1% by weight of the total composition of said perfume ingredient.

Surfactants

The compositions according to the present invention may comprise, as an optional ingredient, a surfactant, or mixtures thereof.

The presence of said surfactants in the compositions of the present invention also allows to provide good cleaning performance on different types of stains and/or soils including bleachable stains like tea, grass, enzymatic stains like blood, greasy stains like barbecue sauce, spaghetti sauce, bacon grease and the like. The presence of said surfactants in the compositions herein may also allow to provide compositions with desired viscosity by appropriately chosen surfactants and levels thereof. Said surfactants help the stable incorporation of said polymer in the compositions of the present invention. Indeed, in the preferred embodiment wherein the compositions herein comprise a bleach, preferably a source of active oxygen, and/or has a low pH, the use of surfactants, may stabilise the polymers described herein. In particular, the silicone glycols as described herein may be stabilised in the above described harsh conditions by micelles formed by certain surfactants.

All types of surfactants may be used in the present invention including nonionic, anionic, cationic, amphoteric or zwitterionic surfactants. It is also possible to use mixtures of such surfactants without departing from the spirit of the present invention.

Accordingly, the compositions according to the present invention comprise up to 50%, preferably of from 0.1% to 20%, more preferably of from 1% to 10%, and most preferably of from 1% to 5% by weight of the total composition of a surfactant, or mixtures there.

Said cationic surfactants have also excellent stability even at the lowest pH. Suitable cationic surfactants to be used herein include derivatives of quaternary ammonium, phosphonium, imidazolium and sulfonium compounds. Preferred cationic surfactants for use herein are quaternary ammonium compounds wherein one or two of the hydrocarbon groups linked to nitrogen are a saturated, linear or branched alkyl group of 6 to 30 carbon atoms, preferably of 10 to 25 carbon atoms, and more preferably of 12 to 20 carbon atoms, and wherein the other hydrocarbon groups (i.e. three when one hydrocarbon group is a long chain hydrocarbon group as mentioned hereinbefore or two when two hydrocarbon groups are long chain hydrocarbon groups as mentioned hereinbefore) linked to the nitrogen are independently substituted or unsubstituted, linear or branched, alkyl chain of from 1 to 4 carbon atoms, preferably of from 1 to 3 carbon atoms, and more preferably are methyl groups.

In the preferred embodiment of the present invention where persulfate salts or mixtures thereof are used as sources of active oxygen, the quaternary ammonium compound is preferably a non-chloride/non halogen quaternary ammonium compound. The counterion used in said quaternary ammonium compounds are compatible with any source of active oxygen and are selected from the group of methyl sulfate, or methylsulfonate, and the like.

Particularly preferred to be used in the compositions of the present invention are trimethyl quaternary ammonium compounds like myristyl trimethylsulfate, cetyl trimethylsulfate and/or tallow trimethylsulfate. Such trimethyl quaternary ammonium compounds are commercially available from Hoechst, or from Albright & Wilson under the trade name EMPIGEN CM®.

Suitable amphoteric surfactants to be used in the compositions according to the present invention include amine oxides having the following formula $R_1R_2R_3NO$ wherein each of R1, R2 and R3 is independently a saturated substituted or unsubstituted, linear or branched alkyl groups of from 1 to 30 carbon atoms, preferably of from 6 to 30 carbon atoms, more preferably of from 10 to 20 carbon atoms, and most preferably of from 8 to 18 carbon atoms. Suitable amine oxides for use herein are preferably compatible with source of active oxygen. Preferred amine oxides for use herein are for instance natural blend $C_8$–$C_{10}$ amine oxides as well as $C_{12}$–$C_{16}$ amine oxides commercially available from Hoechst.

Suitable short chain amine oxides to be used according to the present invention are amine oxides having the following formula $R_1R_2R_3NO$ wherein RI is a $C_6$ to $C_{10}$ alkyl group, preferably a $C_8$ to $C_{10}$ alkyl group and wherein R2 and R3 are independently substituted or unsubstituted, linear or branched alkyl groups of from 1 to 4 carbon atoms, preferably of from 1 to 3 carbon atoms, and more preferably are methyl groups. R1 may be a saturated linear or branched alkyl group. Suitable short chain amine oxides for use herein are preferably compatible with any source of active oxygen. Preferred short chain amine oxides for use herein are for instance natural blend $C_8$–$C_{10}$ amine oxides available from Hoechst.

Suitable nonionic surfactants to be used herein are alkoxylated fatty alcohol nonionic surfactants that can be readily made by condensation processes that are well known in the art. Indeed, a great variety of such alkoxylated fatty alcohols are commercially available which have very different HLB values. The HLB values of such alkoxylated nonionic surfactants depend essentially on the chain length of the fatty alcohol, the nature of the alkoxylation and the degree of alkoxylation. Hydrophilic nonionic surfactants tend to have a high degree of alkoxylation and a short chain fatty alcohol, while hydrophobic surfactants tend to have a low degree of alkoxylation and a long chain fatty alcohol. Surfactants catalogues are available which list a number of surfactants including nonionics, together with their respective HLB values.

Accordingly, preferred alkoxylated alcohols for use herein are nonionic surfactants according to the formula $RO(E)_e(P)_pH$ where R is a hydrocarbon chain of from 2 to 24 carbon atoms, E is ethylene oxide and P is propylene oxide, and e and p which represent the average degree of, respectively ethoxylation and propoxylation, are of from 0 to 24. The hydrophobic moiety of the nonionic compound can be a primary or secondary, straight or branched alcohol having from 8 to 24 carbon atoms. Preferred nonionic surfactants for use in the compositions according to the invention are the condensation products of ethylene oxide with alcohols having a straight alkyl chain, having from 6 to 22 carbon atoms, wherein the degree of ethoxylation is from 1 to 15, preferably from 5 to 12. Such suitable nonionic surfactants are commercially available from Shell, for instance, under the trade name Dobanol® or from Shell under the trade name Lutensol®. These nonionics are preferred because they have been found to allow the formulation of a stable product without requiring the addition of stabilisers or hydrotropes. When using other nonionics, it may be necessary to add hydrotropes such as cumene sulphonate or solvents such as butyldiglycolether.

Particularly suitable anionic surfactants are alkyl-diphenyl-ether-sulphonates and alkyl-carboxylates. Other, suitable anionic surfactants herein include water soluble salts or acids of the formula $ROSO_3M$ wherein R is preferably a $C_{10}$–$C_{24}$ hydrocarbyl, preferably an alkyl or hydroxyalkyl having a $C_{10}$–$C_{20}$ alkyl component, more preferably a $C_{12}$–$C_{18}$ alkyl or hydroxyalkyl, and M is H or a cation, e.g., an alkali metal cation (e.g., sodium, potassium, lithium), or ammonium or substituted ammonium (e.g., methyl-, dimethyl-, and trimethyl ammonium cations and quaternary ammonium cations, such as tetramethylammonium and dimethyl piperdinium cations and quaternary ammonium cations derived from alkylamines such as ethylamine, diethylamine, triethylamine, and mixtures thereof, and the like).

Other anionic surfactants useful for detersive purposes can also be used herein. These can include salts (including, for example, sodium, potassium, ammonium, and substituted ammonium salts such as mono-, di- and triethanolamine salts) of soap, $C_9$–$C_{20}$ linear alkylbenzenesulfonates, $C_8$–$C_{22}$ primary or secondary alkanesulfonates, $C_8$–$C_{24}$ olefinsulfonates, sulfonated polycarboxylic acids prepared by sulfonation of the pyrolyzed product of alkaline earth metal citrates, e.g., as described in British patent specification No. 1,082,179, $C_8$–$C_{24}$ alkylpolyglycolethersulfates (containing up to 10 moles of ethylene oxide); alkyl ester sulfonates such as $C_{14-16}$ methyl ester sulfonates; acyl glycerol sulfonates, fatty oleyl glycerol sulfates, alkyl phenol ethylene oxide ether sulfates, paraffin sulfonates, alkyl phosphates, isethionates such as the acyl isethionates, N-acyl taurates, alkyl succinamates and sulfosuccinates, monoesters of sulfosuccinate (especially saturated and unsaturated $C_{12}$–$C_{18}$ monoesters) diesters of sulfosuccinate (especially saturated and unsaturated $C_6$–$C_{14}$ diesters), acyl sarcosinates, sulfates of alkylpolysaccharides such as the sulfates of alkylpolyglucoside (the nonionic nonsulfated compounds being described below), branched primary alkyl sulfates, alkyl polyethoxy carboxylates such as those of the formula $RO(CH_2CH_2O)_kCH_2COO\text{-}M^+$ wherein R is a $C_8$–$C_{22}$ alkyl, k is an integer from 0 to 10, and M is a soluble salt-forming cation. Resin acids and hydrogenated resin acids are also suitable, such as rosin, hydrogenated rosin, and resin acids and hydrogenated resin acids present in or derived from tall oil. Further examples are given in "Surface Active Agents and Detergents" (Vol. I and II by Schwartz, Perry and Berch). A variety of such surfactants are also generally disclosed in U.S. Pat. No. 3,929,678, issued Dec. 30, 1975 to Laughlin, et al. at Column 23, line 58 through Column 29, line 23.

Preferred anionic surfactants for use in the compositions herein are the alkyl benzene sulfonates, alkyl sulfates, alkyl alkoxylated sulfates, and mixtures thereof.

Thickening System

The compositions herein may comprise a thickener or a thickening system as a highly preferred optional ingredient.

Suitable thickeners herein are selected from the group consisting of organic thickeners and inorganic thickeners and mixtures thereof, preferably organic thickeners, more preferably polysaccharides, and most preferably xanthan gum.

Suitable thickening systems are selected from the group consisting of a cationic/anionic surfactant system self-thickening systems.

Preferably, the compositions herein comprise xanthan gums as a thickener.

The compositions according to the present invention may comprise from 0.05% to 10%, preferably from 0.05% to 5%, more preferably from 0.05% to 3% by weight of the total composition of a thickener or a thickening system.

Depending on the end use envisioned, the compositions according to the present invention may further comprise a variety of other ingredients including dyes, optical brighteners, builders, chelants, pigments, solvents, buffering agents, radical scavengers, polymers, stabilizers and the like.

EXAMPLES

The following examples will further illustrate the present invention. The compositions are made by combining the listed ingredients in the listed proportions (weight % unless otherwise specified). Furthermore, the compositions comprise water and minors up to 100%. The following Examples are meant to exemplify compositions according to the present invention but are not necessarily used to limit or otherwise define the scope of the present invention.

| I)<br>Ingredients | Weight % |
|---|---|
| Kelzan T ® (Xanthan Gum) | 0.3 |
| HLAS (linear alkylbenzene sulfonic acid) | 2.0 |
| Sulfuric acid | 1.0 |
| SF1288 ®* | 5.0 |
| Hydrogen peroxide | 1.0 |

| II)<br>Ingredients | Weight % |
|---|---|
| Sulfuric acid | 3.0 |
| Hexadecyl dimethyl amineoxide | 1.0 |
| Decyl dimethyl amineoxide | 3.0 |
| DC 193 ®* | 2.0 |
| Curox ® (potassium monopersulfate) | 4.0 |

| III)<br>Ingredients | Weight % |
|---|---|
| Kelzan T ® (Xanthan Gum) | 1 |
| HLAS (linear alkylbenzene sulfonic acid) | 2.0 |
| Sulfamic acid | 2.0 |
| DC 5220 ®* | 5.0 |
| Curox ® | 2.0 |

| IV)<br>Ingredients | Weight % |
|---|---|
| Hydroxyethylcellulose | 1 |
| Silicone SF1188 ®* | 7.0 |
| Hydrogen peroxide | 0.5 |

| V)<br>Ingredients | Weight % |
|---|---|
| Hydrogen peroxide | 5 |
| Silicone SF1288 ®* | 7.0 |
| Kelzan T ® (Xanthan Gum) | 0.5 |
| Sodium alkyl sulfate | 4 |
| N-Butoxy propoxy propanol | 4.0 |

| VI)<br>Ingredients | Weight % |
|---|---|
| Sodium hydroxide | 1 |
| Alkyl sulphonate | 5 |
| Sodium hypochlorite | 5 |
| SF1288 ®* | 2 |

*All polymers are intended substantially free of impurities as defined above in the text.

What is claimed is:

1. An acidic cleaning composition comprising:

a bleaching agent wherein said bleaching agent is an hydrogen peroxide bleach;

an acid, wherein said acid is present at a level of from 0.01% to 15% by weight of said composition; and a silicone glycol polymer wherein said polymer is a linear or grafted silicone glycol polymer according to the following formula:

Grafted structure

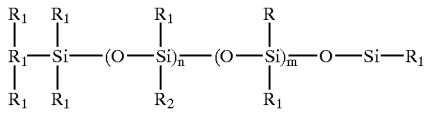

Linear structure

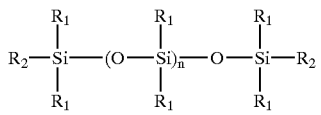

wherein each R1 independently is H or a hydrocarbon radical: R2 is a group bearing a polyether functional group; n is an integer comprised between 0 and 500; and wherein m is an integer comprised between 1 and 300.

2. A composition according to claim 1, wherein said composition comprises from 0.1% to 30% by weight of said bleaching agent.

3. The composition according to claim 1 wherein n+m is greater than 1.

4. A composition according to claim 1, wherein said composition comprises up to 50% by weight of said silicone glycol.

5. A composition according to claim 1, wherein said composition comprises a silicone glycol-raw material wherein said silicone glycol-raw material is substantially free of further ingredients other than the silicone glycol itself.

6. A composition according to claim 1, wherein said composition comprises a silicone glycol-raw material wherein said silicon glycol-raw material comprises more than 80% by weight of silicone glycol.

7. A composition according to claim 1, wherein said composition comprises a silicone glycol-raw material wherein said silicone glycol-raw material comprises less than 20% by weight of un-reacted polyether chain containing C═C double bonds.

8. A composition according to claim 1, wherein said composition comprises a silicone glycol-raw material wherein said silicone glycol-raw material comprises less than 2.5 ppm by weight of heavy metal in the form of heavy metal catalysts-containing catalysts and/or free heavy metal ions.

9. The composition of claim 8 wherein said heavy metal is Platinum.

10. The composition of claim 8 wherein said free heavy metal ions is free Platinum.

11. A method of cleaning a hard surface, said method comprising the step of:

contacting a surface with the acidic cleaning composition of claim 1.

12. The method of claim 11 wherein said composition comprises from 0.1% to 30% by weight of said bleaching agent.

13. The method of claim 11 wherein said composition comprises up to 50% by weight of said silicone glycol.

14. The method of claim 11 wherein said composition comprises a silicone glycol-raw material wherein said silicone glycol-raw material substantially free of further ingredients other than the silicone glycol itself.

15. The method of claim 11 wherein said composition comprises a silicone glycol-raw material wherein said silicone glycol-raw material comprises more than 80% by weight of silicone glycol.

16. The method of claim 11 wherein said composition comprises a silicone glycol-raw material wherein said silicone glycol-raw material comprises less than 2.5 ppm by weight of heavy metal in the form of heavy metal catalysts-containing catalysts and/or free heavy metal ions.

* * * * *